US005215491A

United States Patent [19]

Willet et al.

[11] Patent Number: 5,215,491

[45] Date of Patent: Jun. 1, 1993

[54] WATER ACTUATED TOY KITCHEN SET

[75] Inventors: William Willet, Orange; Milan J. Seda, Laguna Niguel, both of Calif.

[73] Assignee: Mattel, Inc., El Segundo, Calif.

[21] Appl. No.: 832,276

[22] Filed: Feb. 7, 1992

[51] Int. Cl.[5] ..... A63H 29/10; A63H 17/44; A63H 33/00; A63H 3/00

[52] U.S. Cl. ..... 446/176; 446/14; 446/267; 446/268; 446/483

[58] Field of Search ..... 446/14, 144, 145, 176, 446/180, 193, 197, 267, 268, 296, 474, 479, 480, 481, 482, 483, 489

[56] References Cited

U.S. PATENT DOCUMENTS

| | | | |
|---|---|---|---|
| D. 152,185 | 12/1948 | Barr | 446/475 X |
| 2,127,047 | 8/1938 | Pinney | 446/482 X |
| 2,615,280 | 10/1952 | Thelin | 446/474 |
| 2,997,807 | 8/1961 | Woron | 446/479 X |
| 3,015,828 | 1/1962 | Beebe | 446/479 X |
| 3,116,954 | 1/1964 | Orenstein | 446/296 X |
| 3,269,034 | 8/1966 | Glass et al. | 446/482 X |
| 3,765,120 | 10/1973 | Waak | 446/481 |
| 3,842,531 | 10/1974 | Sloan | 446/267 |
| 3,846,933 | 11/1974 | Hill et al. | 446/178 |
| 3,998,001 | 12/1976 | Meyer et al. | 446/197 |
| 4,030,235 | 6/1977 | Terzian et al. | 446/296 |
| 4,057,244 | 11/1977 | Gaspar | 446/482 X |
| 4,114,501 | 3/1978 | Tanaka | 446/193 X |
| 4,332,101 | 6/1982 | Tomita | 446/24 |
| 4,341,034 | 7/1982 | Tsui et al. | 446/474 |
| 4,515,359 | 5/1985 | Mariol | 446/481 |
| 4,917,643 | 4/1990 | Hippely et al. | 446/14 |
| 5,004,445 | 4/1991 | Coleman et al. | 446/481 |

FOREIGN PATENT DOCUMENTS

| | | | |
|---|---|---|---|
| 8002340 | 10/1980 | PCT Int'l Appl. | 446/481 |

*Primary Examiner*—Robert A. Hafer
*Assistant Examiner*—D. Neal Muir
*Attorney, Agent, or Firm*—Roy A. Ekstrand

[57] ABSTRACT

A water actuated toy kitchen set includes a housing having an interior cavity therein supported by a support base. A sink includes a depressible faucet together with a sink well and drain coupling. A dishwasher cavity supports a slidable dishwasher tray, a spray head, a return drain and a pivotable dishwasher door having a transparent window therein. A pressure responsive bellows is operatively coupled to the dishwasher spray head and controls the vertical position of one or more simulated toast slices within a toaster which appears to rest upon the counter top of the kitchen set. A battery-operated pump and pump motor is operatively coupled to a switch mechanism actuated by depressing the faucet to pump water under pressure through the faucet as well as through the dishwasher spray head. Recirculating paths are provided for the pump water to maintain a continuous recycled water flow. A plurality of miniature dishes, preferably coated with a thermochromic material, are supported within a movable dish rack supported within the dishwasher.

11 Claims, 2 Drawing Sheets

WATER ACTUATED TOY KITCHEN SET

FIELD OF THE INVENTION

This invention relates generally to childrens' toys and particularly to those which replicate kitchen appliances and fixtures.

BACKGROUND OF THE INVENTION

One of the more popular groups of toys which have been provided through the years are those generally referred as kitchen toys. Kitchen toys, which are made popular in part by the tendency of young girls to seek to mimic the activities of their parents in the kitchen areas during cooking or other activities, have assumed a variety of shapes and structures. Such kitchen toys have included miniature stoves, refrigerators or other kitchen appliances. Some of these kitchen appliances have included operative features intended to impart a reasonable degree of realistic action to increase the enjoyment on the part of the child user. Other types of kitchen toys have included various miniaturized cooking utensils and other objects generally found about the typical kitchen.

Other related and often similar types of toys include those operating in response to water or water flow. Such toys have included miniature tub and shower facilities as well as replicas of laundry facilities or the like. In many cases, the replicas of tubs, showers or laundry toys have been directed at use with cooperating dolls and doll clothing.

Faced with the continuing need for evermore realistic childrens' toys, practitioners in the art have endeavored to impart realism to their kitchen toys and similar articles. For example, U.S. Pat. No. 4,332,101 issued to Tomita sets forth a TOY KITCHEN ASSEMBLY in which a toy stove assembly includes a housing member configured to simulate a stove having an upper burner portion. A cooking vessel includes an aperture false bottom connected to a conduit that extends to the exterior of the cooking vessel. Pressurized air is generated and connected to the conduit such that air can be introduced into the cooking vessel to simulate boiling of any liquid substance within the cooking vessel. A toy kitchen sink may be included with the stove assembly utilizing the pressurized air to provide water pressure.

U.S. Pat. No. 2,997,807 issued to Woron sets forth a TOY TOASTER having a generally rectangular housing defining a pair of toast receiving slots on the upper surface thereof. A spring loaded toast carrier is vertically movable within the rectangular enclosure to provide movement of simulated bread within the toy toaster corresponding to toast popping up.

U.S. Pat. No. 3,765,120 issued to Waak sets forth a TOY TOASTER including a housing supporting a mechanism having a presettable spring actuated timing device which is operative when a lever is depressed to lower simulated slices of bread through a pair of upper slots into the toy toaster housing.

U.S. Pat. No. 3,846,933 issued to Hill, et al. sets forth a PNEUMATIC TOY STOVE ACCESSORY in which a simulated toy stove is provided with a source of pressurized air. A simulated burner receives the pressurized air and couples it to a simulated uncooked food item such as a pie, cake or the like having a simulated crust or other portion made from a stretchable diaphragm. As the pressurized air builds within the simulated dish, the simulated crust becomes distended and rises simulating the action of a crust in a cooking dish.

U.S. Pat. No. Des.152,185 issued to Barr sets forth a COMBINED TOY SINK WATER DISPENSER AND RECEIVER comprising a miniaturized sink of the type found within a bathroom having a faucet attached thereto and a mirror cabinet supported on the back portion thereof.

U.S. Pat. No. 4,341,034 issued to Tsui, et al. sets forth a TOY WASHING MACHINE having a cabinet including a toy opening and an internally supported tub. A rotatable agitator is supported in a movable fashion within the tub and is driven by an agitating mechanism.

U.S. Pat. No. 3,998,001 issued to Meyer, et al. sets forth a DOLL SHOWER AND BUBBLEBATH DEVICE simulating a shower or bath facility. The device includes a base tub portion having an upstanding post supporting a shower head which includes a spray nozzle. The nozzle is supplied with water through a conduit in response to a bellows-like pump which operates in combination with a check valve to pump water in a recycling fashion from the tub through the conduit and thence from the shower nozzle.

U.S. Pat. No. 3,842,531 issued to Sloan sets forth an AMUSEMENT DEVICE for providing the visual effect of a doll figure being showered. The doll is mounted within an enclosure chamber having partially transparent walls. Water is showered downwardly upon the doll figure under the urging of gravity from an upper reservoir through a nozzle in the upper portion of the fixture.

U.S. Pat. No. 3,015,828 issued to Beebe sets forth a SPRAY BATH having a simulated bathtub together with a recirculating pump which provides a pressurized liquid stream to a flexible hose terminating in a spray nozzle.

U.S. Pat. No. 4,917,643 issued to Hippely, et al. sets forth a TOY VEHICLE WITH THERMOCHROMIC MATERIAL in which a toy vehicle is painted with a thermochromic paint to provide a variety of patterns, designs and the like which change color in response to temperature variations.

While the foregoing described prior art devices have provided entertaining and often amusing toys for use by younger children, there remains a continuing need in the art for evermore improved and realistic childrens' kitchen set type toys.

SUMMARY OF THE INVENTION

Accordingly, it is a general object of the present invention to provide an improved kitchen toy. It is a more particular object of the present invention to provide an improved toy which utilizes water under pressure for several activities to enhance toy realism.

In accordance with the present invention, there is provided a water actuated toy kitchen set comprises: a housing defining an interior cavity, a dishwasher door and a counter top; a toaster housing defining a toaster cavity and an upwardly facing slot; a simulated toast slice extending upwardly through the slot; water pressure responsive means supporting the simulated toast slice within the toaster cavity; a sink having a faucet and drain aperture; a dishwasher supported proximate the dishwasher door; and pump means for circulating a liquid such as water through the faucet and the dishwasher and for applying water pressure to the water pressure responsive means to raise the simulated toast slice upwardly through the slot.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED

Figure 1:
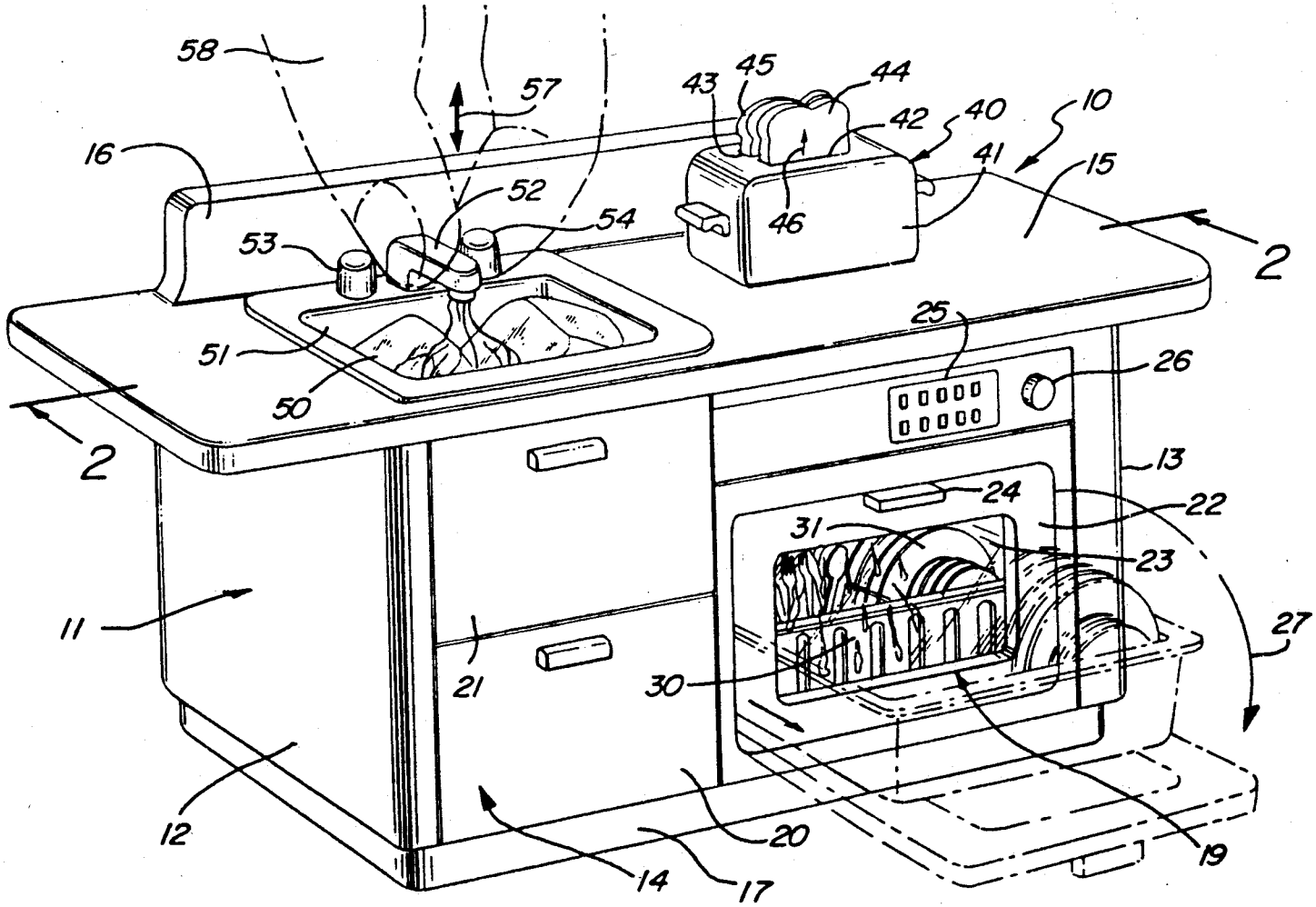
FIG. 1 sets forth a perspective view of a water actuated toy kitchen set constructed in accordance with the present invention.

FIG. 1 sets forth a perspective view of a toy kitchen set constructed in accordance with the present invention and generally referenced by numeral 10. Toy kitchen set 10 includes a generally rectangular housing 11 having a supporting base 17, a pair of side portions 12 and 13 and a front portion 14. A generally planar counter top 15 is secured to and supported by housing 11. Counter top 15 further includes upwardly extending splash guard 16 positioned along the rear edge of the counter top. Front portion 14 further defines a pair of simulated drawer fronts 20 and 21 as well as a plurality of simulated controls 25 and 26. A dishwasher door 22 is hingedly secured to front portion 14 and includes a handle 24 and a transparent window 23. Within the interior of housing 11 behind hingeably mounted door 22, a movable dishrack 30 is provided which supports a plurality of stacked dishes 31. Dishwasher door 22 is hinged along the bottom edge thereof and thus is rotatable between the closed position shown and an open position shown in dashed-line representation by pivoting dishwasher door 22 in the direction indicated by arrow 27. With dishwasher door 22 pivoted to the open position, dishrack 30 is movable to the extended position shown in dashed line representation carrying dishes 31 along with it.

A simulated toaster 40 is secured to counter top 15 and includes a generally rectangular housing 41 defining a pair of toast receiving slots 42 and 43. A corresponding pair of simulated toast slices 44 and 45 are received within housing 41 by passing through slots 42 and 43 respectively. In accordance with an important aspect of the present invention set forth below in greater detail, simulated toast slices 44 and 45 may be raised vertically in the direction indicated by arrow 46 to extend upwardly through slots 42 and 43 in the manner typical of toast which has "popped up".

Toy kitchen 10 further includes a sink 5-n having a generally rectangular sink well 51 and supporting a faucet 52 together with hot and cold water knobs 53 and 54 respectively on either side of faucet 52.

In operation, and by means set forth below in greater detail, a user extending his or her hand in the manner indicated by dashed-line hand 58 depresses faucet 52 in the direction indicated by arrow 57. By means set forth below in greater detail, the depressing of faucet 52 downwardly in the direction indicated by arrow 57 activates a water circulating pump (seen in FIG. 2) which produces a water flow 55 traveling outwardly from faucet 52 and into sink well 51. Simultaneously, and also by means set forth below in greater detail, the activation of the water pump within housing 11 produces sufficient water pressure to activate a pressure bellows (seen in FIG. 2) to temporarily raise simulated toast slices 44 and 45 to the extended position shown in FIG. 1. Finally, by way of further addition, the actuation of the water pump within housing 11 also produces a water flow within the interior of dishwasher 19 causing a water flow to be visible through transparent window 23 while flowing downwardly across dishes 31. The action of the water pump within housing 11 continues so long as the user applies a downward pressure to faucet 52. Accordingly, simulated toast slices 44 and 45 will also remain in a raised position so long as faucet 52 is pressed. Finally, a flow of water through dishwasher 19 also continues so long as faucet 52 is pressed. With the release of faucet 52, the water pump within housing 11 ceases operation and the water flow from faucet 52 and within dishwasher 19 ceases. Correspondingly, in the absence of a sustaining water pressure, the bellows mechanism shown in FIG. 2 which is operative upon simulated toast slices 44 and 45 collapses causing the simulated toast slices to be drawn downwardly into the interior of housing 41.

Once the user again depresses faucet 52, the water flow from faucet 52 and within dishwasher 19 again resumes as does the raising of simulated toast slices 44 and 45. In accordance with the preferred form of the invention, dishes 31 are fabricated having a thermochromic material covering which exhibits a color change property in response to temperature changes. Thus, the cooling of water flow 55 by one or more portions of ice 56 within sink well 51 produces a cooling of the circulating water including that dispersed across dishes 31 within dishwasher 19. The resulting cooling of dishes 31 causes the corresponding thermochromic change effect producing a change in visible appearance of the dishes. Of course, the temperature of water within the circulating system of toy kitchen set 10 may be heated by adding previously heated water or by running water flow 55 over a heated item to restore the thermochromic color dishes to their previous or room temperature color.

Figure 2:
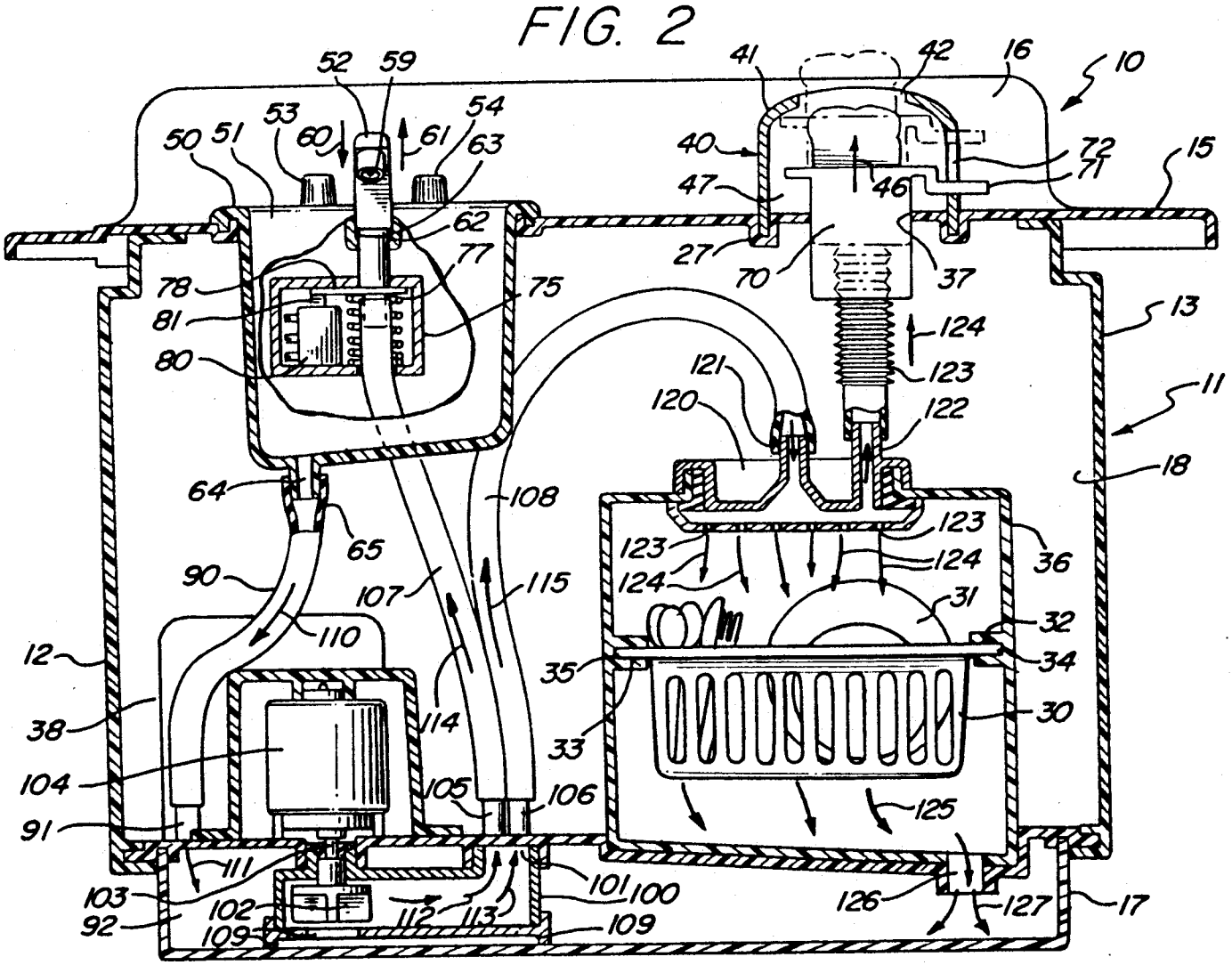
FIG. 2 sets forth a section view of the present invention water actuated toy kitchen set taken along section lines 2—2 in FIG. 1.

FIG. 2 sets forth a section view of the present invention toy kitchen set taken along section lines 2—2 in FIG. 1. As is set forth above, toy kitchen set 10 includes a housing 11 having side portions 12 and 13 and a support base 17. Housing 11 is hollow defining an interior cavity 18. A generally planar counter top 15 includes a vertical extending splash guard 16. Counter top 15 further defines a generally U-shaped groove 27 extending downwardly from the upper surface of counter top 15. A toaster 40 includes a housing 41 defining a pair of toast receiving slots 42 and 43 (better seen in FIG. 1). Housing 41 is received within groove 27 and secured therein to counter top 15 by conventional attachment means such as adhesive bonding. Housing 41 further defines a vertically extending slot 72. A toast carrier 70 is received within an aperture 37 defined in counter top 15 and is vertically movable within housing 41. A simulated toast slice 44 is coupled to toast carrier 70 and movable therewith. Toast carrier 70 further includes an outwardly extending handle 71 which passes through housing 41 at slot 72. An expandable bellows 123 supports toast carrier 70 and is operative in the manner set forth below to raise and lower simulated toast slices 44 and 45 in response to water pressure within bellows 123.

A sink 50 is supported upon counter top 15 and defines a sink well 51 having a drain coupling 64 formed in the bottom portion thereof. Sink 50 further includes a vertically extending guide 62 having a passage 63 defined therein. A faucet 52 includes a nozzle 59 and is movably supported within passage 63 of guide 62 in vertical motion indicated by arrows 60 and 61.

A switch housing 75 is received and supported within the interior of housing 11 near sink 50 and supports a push button switch 80 having an upwardly extending push button 81. A flange 78 is secured to the lower portion of faucet 52 which extends downwardly into switch housing 75 via aperture 76. A return spring 77 is supported within switch housing 75 and provides a return force operative upon flange 78 to urge faucet 52 upwardly to its raised position. A hose 107 is coupled to faucet 52 within switch housing 75 and extends downwardly therefrom to a coupling 105.

A pump housing 100 is supported within support base 17 and defines a plurality of inlet ports 109 and a discharge port 101. Pump housing 100 supports a rotatable impeller 102 coupled to a motor shaft 103 extending outwardly from pump housing 100. A pump motor 104 is supported above pump housing 100 and is operatively coupled to shaft 103 such that energizing pump 104 rotates shaft 103 and impeller 102 to provide a pressurized flow of water outwardly through discharge port 101 and to draw return water inwardly to pump housing 100 through return water inlets 109. A pair of couplings 65 and 91 together with a hose 90 provide a return connection between drain 64 of sink 50 and pump reservoir 92 within support base 17. A pair of couplings 105 and 106 are coupled to discharge port 101. Coupling 105 is connected to a hose 107 which in turn is connected to faucet 52. Coupling 106 is connected to output hose 108.

A dishwasher housing 36 is supported within housing 11 and defines a pair of inwardly extending channels 32 and 33. A dishrack 30 supporting a plurality of dishes 31 includes a pair of outwardly extending lips 34 and 35 received within channels 32 and 33 respectively in a sliding engagement. A spray head 120 is supported within the upper portion of dishwasher housing 36 and includes a coupler 121 connected to hose 108 and a coupling 122 coupled to the lower end of bellows 123. Dishwasher housing 36 further defines a drain 126 at the lower portion thereof.

In operation, and in the absence of downward pressure upon faucet 52, spring 77 urges flange 78 and faucet 52 upwardly to their raised positions as shown in FIG. 2. With flange 78 raised, pushed button 81 is raised to its off position causing switch 50 to be inoperative. By means not shown but in accordance with conventional fabrication techniques, pump motor 104 and switch 80 are operatively coupled in a conventional circuit arrangement to a source of electrical power such as one or more batteries (not shown). Thus, with switch 80 open, pump motor 104 is not energized and, as a result, impeller 102 is stationary. In the absence of energizing with pump 104 inoperative, water pressure is not applied to bellows 123 and the weight of simulated toast slice 44 and toast carrier 70 collapses bellows 123 causing simulated toast slice 44 to be lowered downwardly through slot 42. Concurrently, simulated toast 45 is lowered downwardly through slot 43 (seen in FIG. 1). Also, in the absence of energizing of pump motor 104, water flow within the kitchen toy set ceases.

To operate the pump mechanism of toy kitchen set 10, the user, as mentioned above, presses downwardly upon faucet 52 in the direction indicated by arrow 60. The downward movement of faucet 52 cause a corresponding downward motion of flange 78 which depresses push button 81 of switch 80 causing pump motor 104 to be energized. The energizing of pump motor 104 rotates impeller 102 within pump housing 100 producing a pressurized water flow outwardly through discharge port 101 in the direction indicated by arrows 112 and 113. The pressurized water flow from discharge port 101 is divided between couplers 105 and 106 forming a portion flowing upwardly through hose 107 as indicated by arrow 114 and a portion flowing upwardly through hose 108 as indicated by arrow 115.

The water flow upwardly through hose 107 travels through faucet 52 and is discharged downwardly through nozzle 59 thereof. The downward flow of water from nozzle 59 is collected within sink well 51 and returns to pump reservoir 92 through drain 64, coupling 65, hose 90 and coupling 91 in the manner indicated by arrows 110 and 111. Thus, hose 90 provides one return drain path for the circulating water flow.

The portion of pressurized water flowing upwardly through hose 108 is received within spray head 120 producing a pressurized condition within the interior of the spray head. This pressurized condition provides a spray-like downward flow through orifices 123 formed in the lower surface of spray head 120 causing a plurality of water jets 124 to be directed upon dishes 31. This flowing water flows downwardly through dishrack 30 as indicated by arrow 125 and returns to pump housing 100 through drain 126 as shown by arrows 127. Concurrently, the pressurizing of spray head 120 produces a water pressure which is coupled by coupling 122 to expandable bellows 123. The water pressure acts upon expandable bellows 123 to produce expansion thereof which in turn raises toast carrier 70 and simulated toast slices 44 and 45 upwardly through slots 42 and 43 respectively (seen in FIG. 1) of toaster 40 in the direction indicated by arrow 46. This raised position of simulated toast slices 44 and 45 is maintained so long as pump 104 is operative due to the downward force upon faucet 52. As faucet 52 remains pressed downwardly, pump 104 continues to circulate water upwardly through hoses 107 and 108 to produce water streams emanating from nozzle 59 of faucet 52 and orifices 123 of spray head 120.

This water continues to circulate in the manner described and subject only to the limitations of available battery energy could run indefinitely so long as the user continues to depress faucet 52.

Upon release of faucet 52, the spring force of return spring 77 raises faucet 52 and flange 78 opening push button switch 80 and terminating the energy coupling to motor 104. As described above, once motor 104 ceases to operate, the pressure within bellows 123 is insufficient to sustain the weight of toast carrier 70 and simulated toast slices 44 and 45. As a result, toast carrier 70 again drops drawing simulated toast 44 and 45 into the interior of housing 41 of toaster 40.

What has been shown is a novel water actuated toy kitchen set in which circulating water under pressure provides simulated dishwashing as well as water flow through the sink portion in a realistic fashion. In addition, a water actuated bellows mechanism is coupled to a movable toast carrier within a simulated toaster to raise and lower one or more simulated toast slices. The recirculating character of the water actuated toy set shown permits the recirculating water to be cooled or heated to activate the color change characteristic of a plurality of thermochromic material coated dishes within the dishwater providing an enhanced appearance change within the dishwasher seemingly in response to the dishwashing action. This change may, in accordance with designer's choice, provide the appearance of disappearing food and refuse particles or may provide a simple color change of the dishes during the wash cycle.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A liquid actuated toy kitchen set comprising:

a housing, a sink and faucet supported by said housing;

liquid circulating means for circulating liquid through said faucet and sink;

a toy toaster having a raisable simulated toast slice therein; and toast slice raising means responsive to said liquid circulated by said liquid circulating means for raising said simulated toast slice.

2. A liquid actuated toy kitchen set as set forth in claim 1 further including a simulated dishwasher operatively coupled to said liquid circulating means and wherein said liquid circulating means also circulates liquid through said dishwasher.

3. A liquid actuated toy kitchen set as set forth in claim 2 wherein said liquid circulating means includes a battery driven pump.

4. A water actuated toy kitchen set comprising:

a housing defining an interior cavity, a door for a simulated dishwasher and a counter top;

a toy toaster housing defining an upwardly open cavity and an upwardly facing slot;

a simulated toast slice extendable upwardly through said slot;

water pressure responsive means supporting said simulated toast slice within said toaster cavity;

a sink having a faucet and a sink drain aperture;

a simulated dishwasher supported proximate said door;

pump means for circulating a liquid such as water through said faucet and said dishwasher and for applying water pressure to said water pressure responsive means to raise said simulated toast slice upwardly through said slot.

5. A water actuated toy kitchen set as set forth in claim 4, wherein said water pressure responsive means includes an expandable bellows coupled to said pump means and said simulated toast slice.

6. A water actuated toy kitchen set as set forth in claim 5 wherein said water pressure responsive means further includes a toast carrier supporting said simulated toast slice and being supported by said bellows.

7. A water actuated toy kitchen set as set forth in claim 6 wherein said sink includes means for supporting said faucet movable in a vertical path and wherein said pump means includes a pump motor and a switch operatively coupled to said faucet so as to be actuated by user depression thereof.

8. A water actuated toy kitchen set as set forth in claim 7 wherein said dishwasher includes a spray head coupled to said pump means and a slidably supported dishrack.

9. A water actuated toy kitchen set as set forth in claim 8 further including a plurality of toy dishes receivable within said dishrack through said dishwasher door.

10. A water actuated toy kitchen set as set forth in claim 9 wherein said sink, said dishwasher and said pump means are configured to provide mixing between liquid circulating therethrough.

11. A water actuated toy kitchen set as set forth in claim 10 wherein said toy dishes include toy dishes having thermochromic characteristics.

* * * * *